US009541245B2

(12) United States Patent
Floersch et al.

(10) Patent No.: US 9,541,245 B2
(45) Date of Patent: Jan. 10, 2017

(54) MODULAR VALANCE FIXTURE

(71) Applicant: Target Brands, Inc., Minneapolis, MN (US)

(72) Inventors: David J. Floersch, Minneapolis, MN (US); William Y. Stafford, Minnetrista, MN (US); Kenneth Fee, Jamestown, RI (US); Robert M. Rondeau, Pawtucket, RI (US); Alex K. Poniatowski, Brooklyn Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 220 days.

(21) Appl. No.: 14/617,034

(22) Filed: Feb. 9, 2015

(65) Prior Publication Data

US 2016/0230946 A1 Aug. 11, 2016

(51) Int. Cl.

| | |
|---|---|
| ***F21S 4/00*** | (2016.01) |
| ***A47F 3/00*** | (2006.01) |
| ***A47F 5/00*** | (2006.01) |
| ***A47F 11/10*** | (2006.01) |
| *F21W 131/301* | (2006.01) |
| *F21W 131/405* | (2006.01) |

(52) U.S. Cl.

CPC ..... *F21S 4/28* (2016.01); *A47F 3/001* (2013.01); *A47F 5/0043* (2013.01); *A47F 11/10* (2013.01); *F21W 2131/301* (2013.01); *F21W 2131/405* (2013.01); *F21Y 2115/10* (2016.08)

(58) Field of Classification Search

CPC .. F21S 4/28; F21Y 2215/10; F21W 2131/301; F21W 2131/405; A47F 3/001; A47F 5/0043; A47F 11/10

USPC ..... 362/223

See application file for complete search history.

(56) References Cited

U.S. PATENT DOCUMENTS

| | | | | |
|---|---|---|---|---|
| 2,284,194 | A | 5/1942 | Gangbin | |
| 2,514,049 | A | 7/1950 | Graham | |
| 2,564,865 | A | 8/1951 | Turner et al. | |
| 2,708,711 | A * | 5/1955 | McGinty | F21V 33/0016 160/19 |
| 2,986,627 | A * | 5/1961 | Marriett | F21V 11/16 160/38 |
| 3,865,248 | A | 2/1975 | Donovan et al. | |
| D268,367 | S | 3/1983 | Paquette et al. | |
| 4,994,943 | A | 2/1991 | Aspenwall | |
| D330,090 | S | 10/1992 | Walter et al. | |
| D365,955 | S | 1/1996 | Fimbres | |

(Continued)

*Primary Examiner* — Bryon T Gyllstrom

(74) *Attorney, Agent, or Firm* — Leanne Taveggia Farrell; Westman, Champlin & Koehler, P.A.

(57) ABSTRACT

A modular valance fixture includes at least one elongated light fixture including a channel frame having a first end and a second end and to which a plurality of lights are mounted. At least two identical bases each have a distal end and a mounting end that mounts to a wall. At least two identical sleeves each include a slide end that telescopically receives the distal end of one of the bases, a distal end and a tube having a first side and a second side. Each of the at least two identical sleeves are oriented to either act as a left-handed support or as a right-handed support for the at least one elongated light fixture. The first side of each tube of the identical sleeves includes a cutout that faces one of the first and the second ends of the channel frame of the light fixture.

20 Claims, 16 Drawing Sheets

(56) References Cited

U.S. PATENT DOCUMENTS

| | | | | |
|---|---|---|---|---|
| 5,690,415 | A * | 11/1997 | Krehl | A47F 5/101 108/23 |
| 5,908,179 | A * | 6/1999 | Fimbres | F16L 3/227 160/10 |
| 6,270,232 | B1 * | 8/2001 | Shemitz | A47F 11/10 362/125 |
| 6,431,721 | B2 | 8/2002 | Shemitz et al. | |
| 6,808,285 | B2 | 10/2004 | Shemitz et al. | |
| 6,827,465 | B2 * | 12/2004 | Shemitz | A47F 11/10 362/125 |
| D521,286 | S | 5/2006 | Colmenares | |
| 7,600,888 | B1 | 10/2009 | Miller | |
| D627,914 | S | 11/2010 | Couture | |
| 7,862,195 | B2 | 1/2011 | Stack et al. | |
| 7,963,661 | B2 * | 6/2011 | Meeks | A47F 11/10 362/217.12 |
| 8,092,040 | B2 | 1/2012 | Wu et al. | |
| 8,215,795 | B2 | 7/2012 | Pichel | |
| D667,585 | S | 9/2012 | Yamazaki et al. | |
| 8,430,525 | B2 | 4/2013 | Wang | |
| D707,874 | S | 6/2014 | Sieberth et al. | |
| 2004/0264161 | A1 * | 12/2004 | Wu | A47F 5/0018 362/602 |
| 2007/0177392 | A1 * | 8/2007 | Grigorik | F21S 8/033 362/382 |
| 2008/0285260 | A1 * | 11/2008 | Sherman | A47F 5/0043 362/133 |
| 2011/0058357 | A1 | 3/2011 | Anderson | |
| 2012/0042549 | A1 * | 2/2012 | Schattinger | G09F 13/18 40/541 |
| 2014/0218896 | A1 | 8/2014 | Karan | |
| 2016/0061429 | A1 * | 3/2016 | Waalkes | F21V 23/008 362/217.15 |

* cited by examiner

MODULAR VALANCE FIXTURE

BACKGROUND

There are a variety of ways to use lighting in a retail store. One way to encourage customers to look further at an item is the use of valance lighting. Valance lighting places lights above or below an object or objects on display and is generally hidden behind a board or panel to create an effect of lighting up a specific place.

The discussion above is merely provided for general background information and is not intended to be used as an aid in determining the scope of the claimed subject matter.

SUMMARY

A modular valance fixture includes at least one elongated light fixture having a channel frame to which a plurality of lights are mounted and that contains components for providing the plurality of lights with power and a diffuser that covers the plurality of lights. The channel frame includes a first end and a second end. At least two identical bases each have a distal end and a mounting end that mounts to a wall. At least two identical sleeves each include a slide end that telescopically receives the distal end of one of the bases, a distal end and a tube having a first side and a second side. The first side of each tube of the identical sleeves includes a cutout. Each of the at least two identical sleeves are oriented in one of two orientations so as to either act as a left-handed support or as a right-handed support for the at least one elongated light fixture. A first orientation includes the first side being oriented such that the cutout is located on a left-handed side of the sleeve and faces the first end of the channel frame. A second orientation includes the first side being oriented such that the cutout is located on a right-handed side of the sleeve and faces the second end of the channel frame.

A modular valance fixture includes a first support arm having an inner assembly having a bracket end that is mounted to a wall and a distal end and an outer assembly having an inner assembly receiving end and a distal end. The outer assembly includes a cutout located on one side of a tube of the outer assembly. A second support arm includes an inner assembly that is identical to the inner assembly of the first support arm and an outer assembly that is identical to the outer assembly of the first support arm. At least one light assembly includes a housing to which a plurality of lights are mounted and that contains components for providing the plurality of lights with power. The at least one light assembly is supported away from the wall by at least one of the first support arm and the second support arm. The identical outer assemblies are assembled to the identical inner assemblies so that the side of the outer assembly of the first support arm that includes the cutout is facing a first end of the housing of the at least one light assembly and the side the outer assembly of the second support arm that includes the cutout is facing a second end of the housing of the at least one light assembly.

A method of assembling a modular valance fixture includes mounting a first support arm to a wall by attaching an inner assembly to the wall and sliding an outer assembly telescopically onto a distal end of the inner assembly. The outer assembly is slid on the distal end of the inner assembly so that a side of the outer assembly that has a cutout is on a left-handed side and the cutout is located proximate to a distal end of the outer assembly. A second support arm is mounted to the wall by attaching an inner assembly that is substantially identical to the inner assembly of the first support arm to the wall and sliding an outer assembly that is substantially identical to the outer assembly of the first support arm telescopically onto a distal end of the inner assembly of the second support arm. The outer assembly of the second support arm is slid on the distal end of the inner assembly of the second support arm so that a side of the outer assembly that has a cutout is on a right-handed side and the cutout is located proximate to a distal end of the outer assembly of the second support arm. A light assembly is supported away from the wall with the first support arm and the second support arm. The cutout on the outer assembly of the first support arm faces a first end of the light assembly and the cutout on the outer assembly of the second support arm faces a second end of the light assembly.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A modular valance fixture includes a light assembly that is mounted to a wall, but spaced a sufficient distance from the wall by support arms so as to provide a wash of light that illuminates objects or graphics that are being displayed. The modular valance fixture uses substantially identical components for the support arms, but in different positions to provide a right-handed or a left-handed support arm for the valance fixture. Using the same parts to create the valance fixture reduces burdens on manufacture and distribution as well as gives a retail store advantages in assembly.

Figure 1:
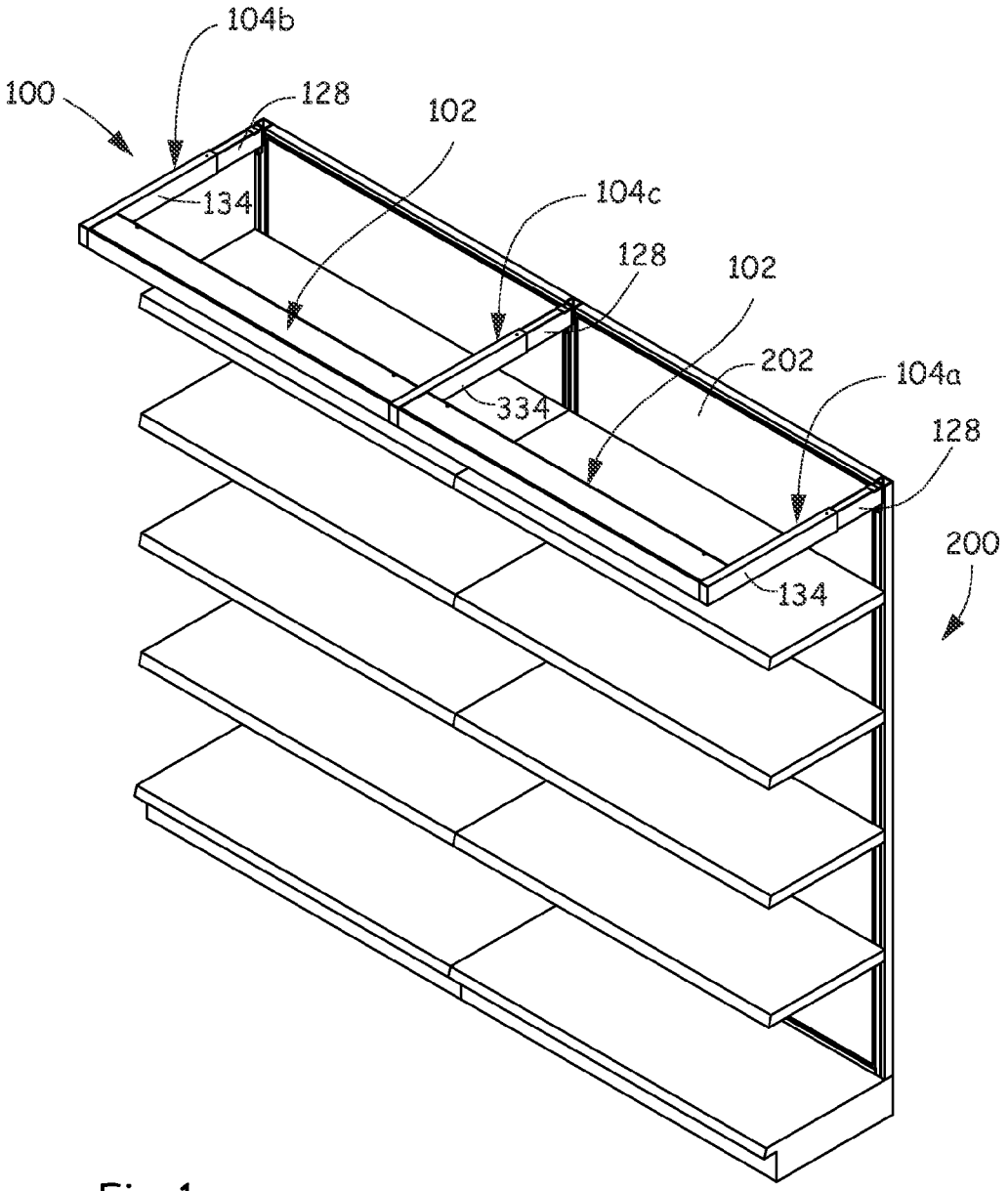
FIG. 1 is a perspective view of a modular valance fixture mounted to a gondola display fixture according to one embodiment.

FIG. 1 is a perspective view of a modular valance fixture 100 mounted to a gondola display fixture 200 according to one embodiment. Modular valance fixture 100 includes at least one elongated light fixture or light assembly 102. In FIG. 1, two elongated light fixtures or light assemblies 102 are shown. Modular valance fixture 100 further includes at least two support arms. In FIG. 1, a first support arm 104*a*, a second support arm 104*b* and a third support arm 104*c* are shown.

Figure 2:
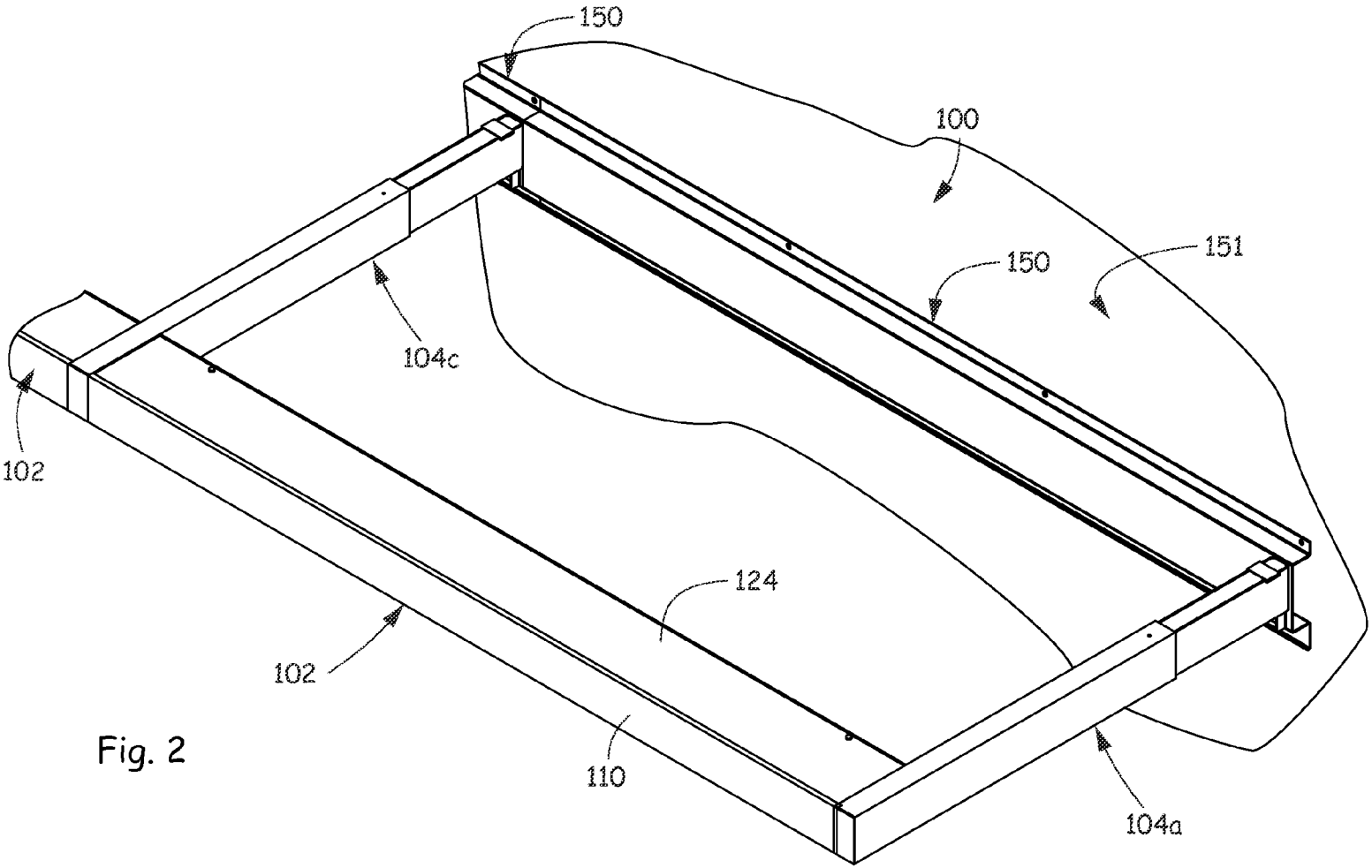
FIG. 2 is a perspective view of a portion of the modular valance fixture illustrated in FIG. 1, but mounted to a wall with a wall bracket according to another embodiment.
Figure 3:
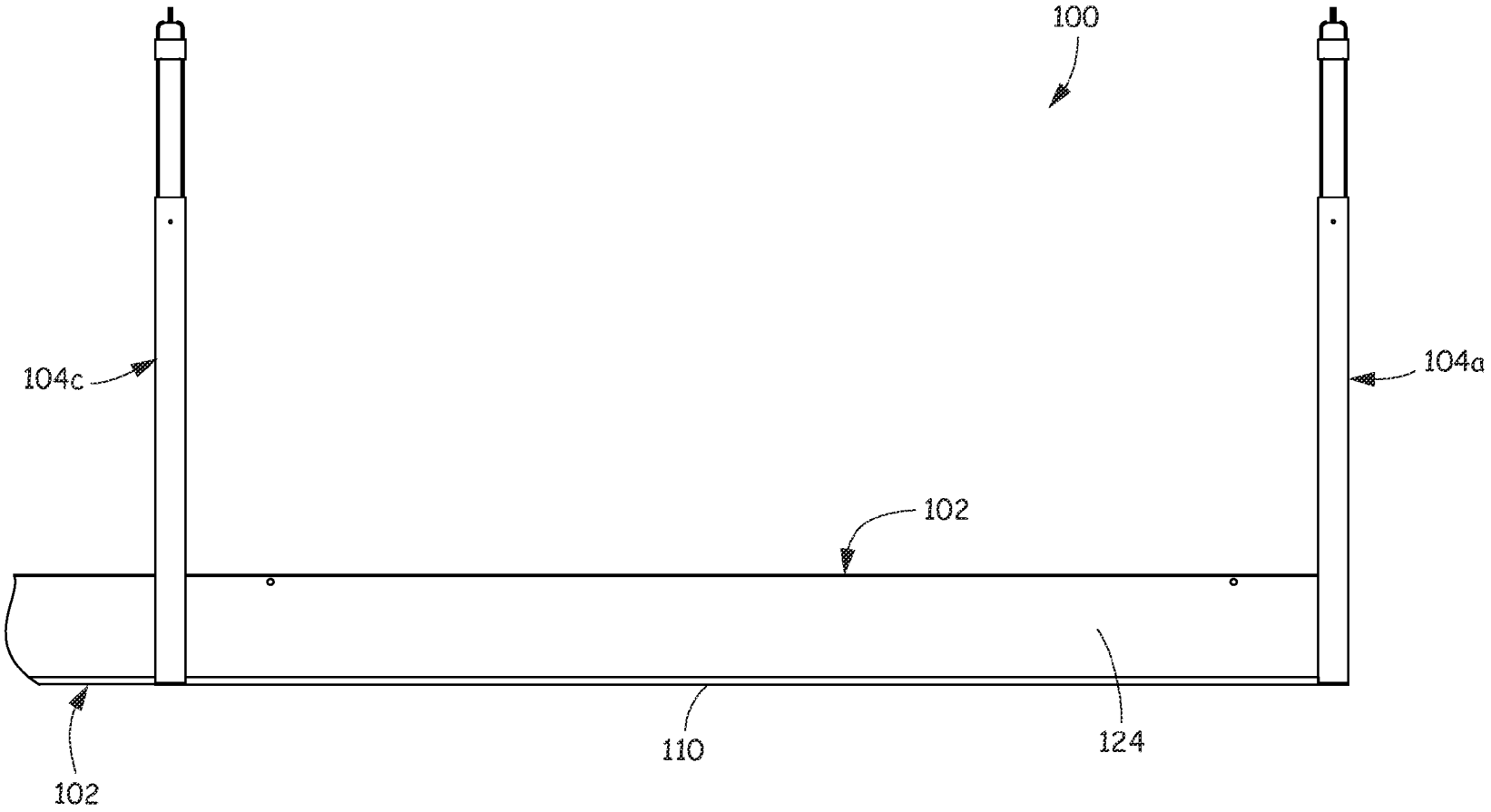
FIG. 3 is a top view of FIG. 2 without the wall bracket.
Figure 4:
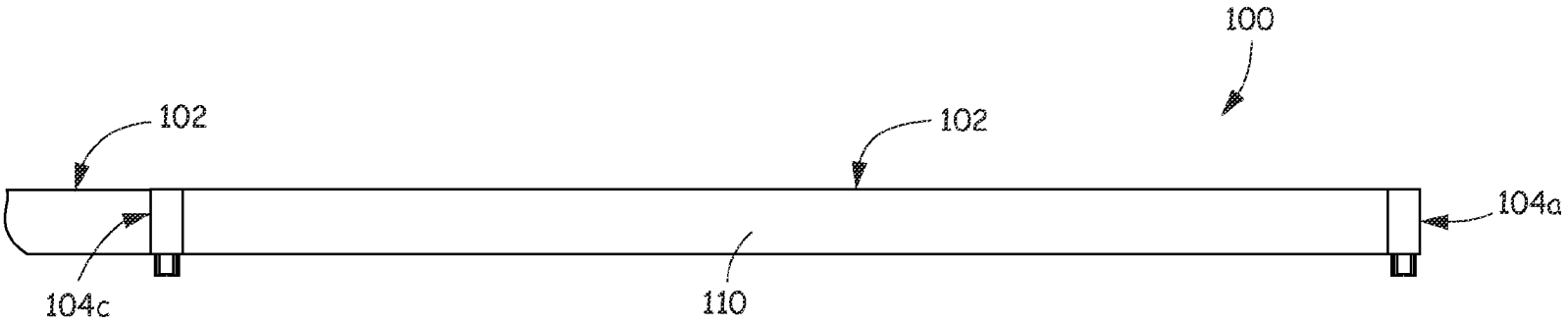
FIG. 4 is a front view of FIG. 2 without the wall bracket.
Figure 5:
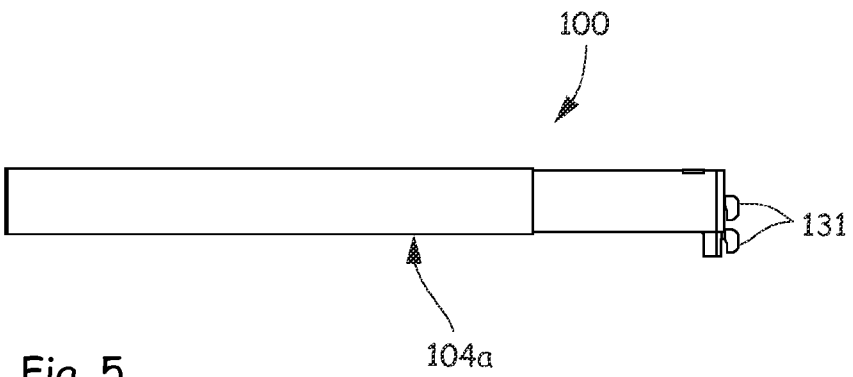
FIG. 5 is a right side view of FIG. 2 without the wall bracket.

FIG. 2 is a perspective view of a portion of modular valance fixture 100 including first support arm 104*a*, third support arm 104*c* and first elongated light fixture 102, but mounted to a wall 151 of a retail store with a wall bracket 150 according to another embodiment. FIG. 3 is a top view of fixture 100 with wall bracket 150 removed, FIG. 4 is a front view of fixture 100 with wall bracket 150 removed and FIG. 5 is a right side view of fixture 100 with wall bracket 150 removed. First support arm 104*a* and third support arm 104*c* position first elongated light fixture 102 away from wall 202 of gondola display fixture 200 in FIG. 1 and away from wall 151 in FIG. 2. Second support arm 104*b* and third support arm 104*c* position second elongated light fixture 102 away from wall 202 in FIG. 1 and wall 151 in FIG. 2.

Figure 6:
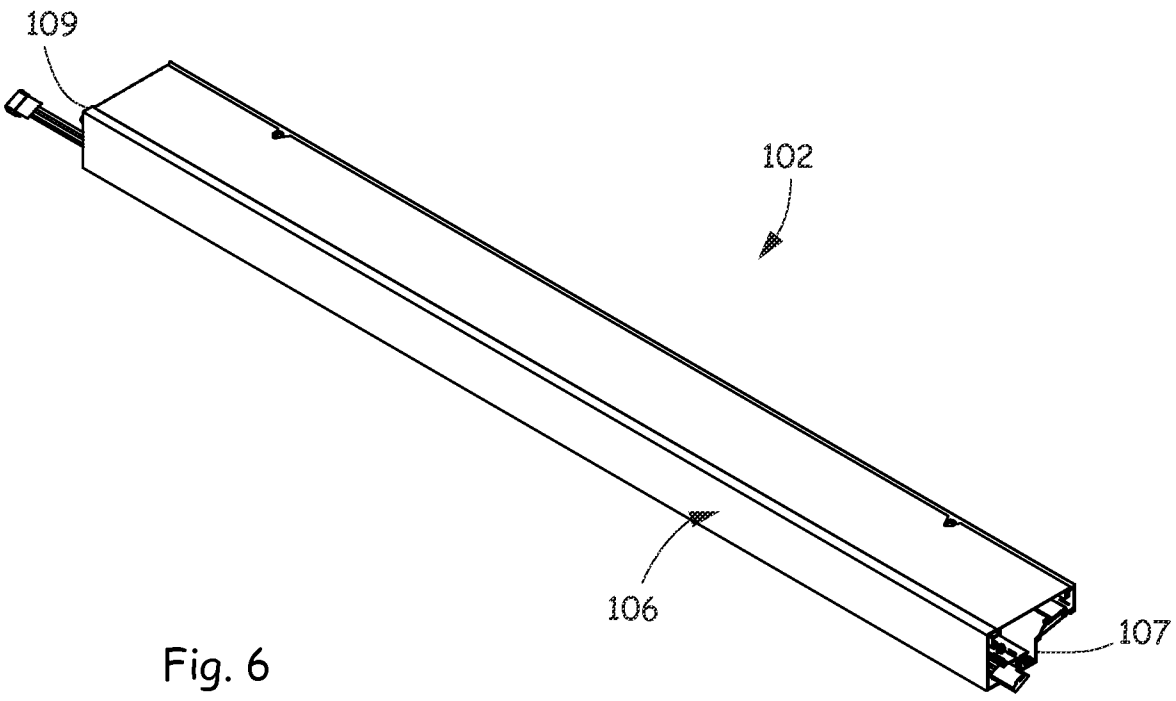
FIG. 6 is a perspective view of a light assembly of the modular valance fixture of FIGS. 1 and 2.
Figure 7:
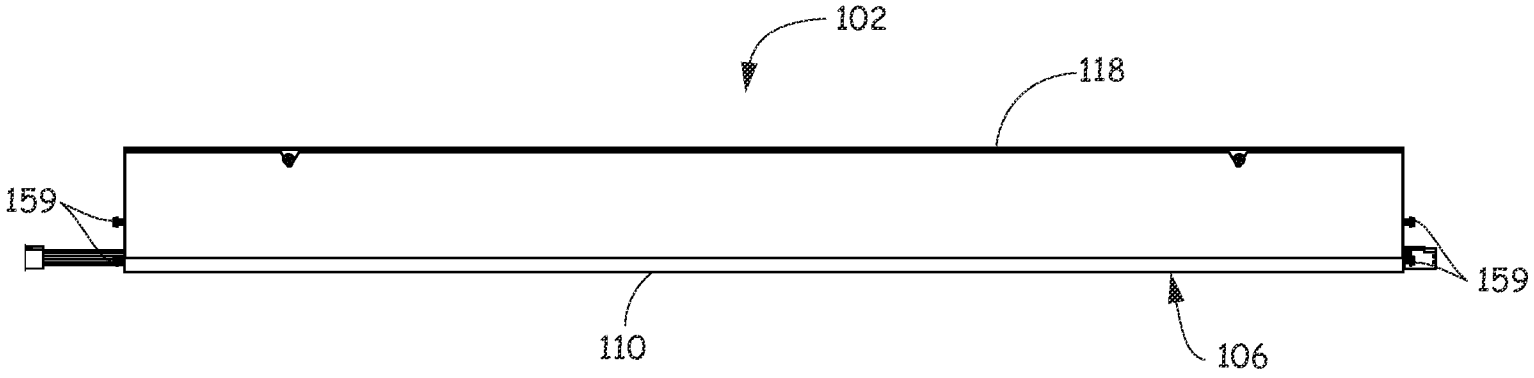
FIG. 7 is a top view of FIG. 6.
Figure 8:
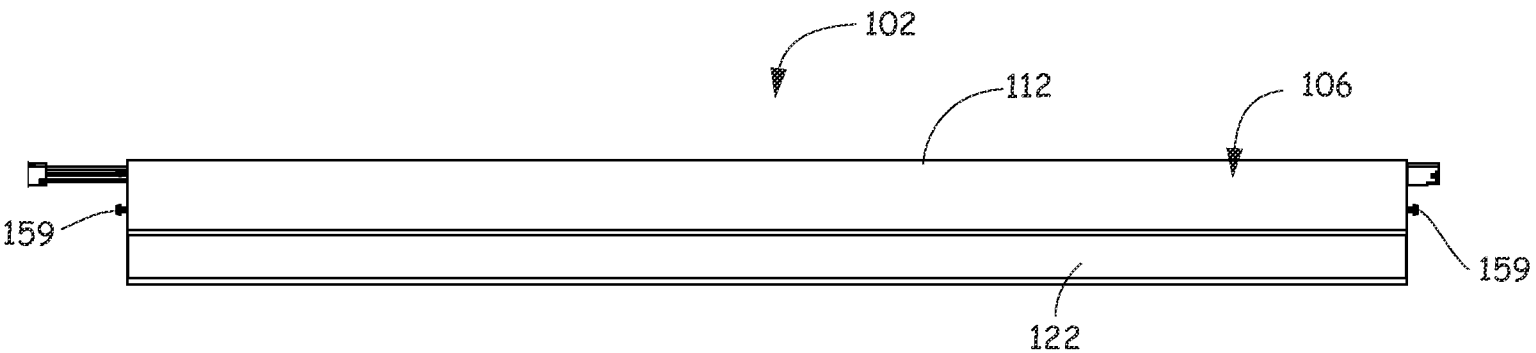
FIG. 8 is bottom view of FIG. 6.
Figure 9:
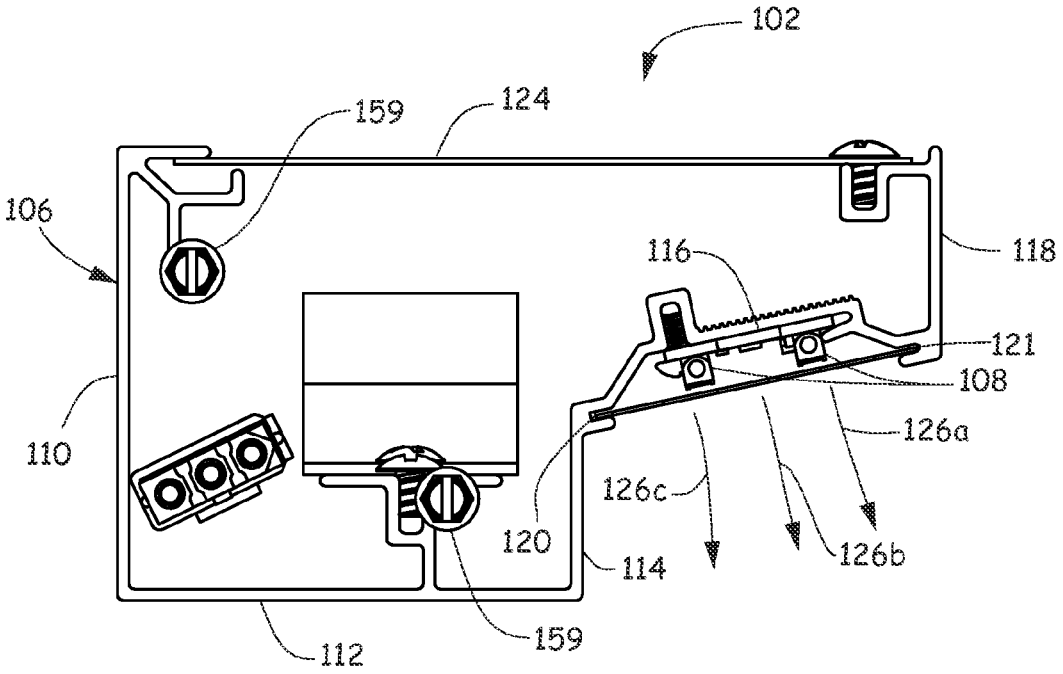
FIG. 9 is an enlarged right side view of FIG. 6.

FIG. 6 is a perspective view of light assembly 102. In particular, FIG. 6 is a perspective view of first elongated light fixture 102, but second elongated light fixture 102 is identical to first elongated light fixture 102. In fact, any of the elongated light fixtures used in modular valance fixture 100 are identical. FIG. 7 is a top view of light assembly 102, FIG. 8 is a bottom view of light assembly 102 and FIG. 9 is an enlarged right side view of light assembly 102.

Elongated light fixture 102 includes a housing or channel frame 106 to which a plurality of lights 108 are mounted and that contains components for providing the plurality of lights 108 with power. For example, lights 108 can be LEDs that are provided on a board that is mounted to housing or channel frame 106 and housing or channel frame 106 can contain various lighting components, such as wires, quick connects, an LED driver and bolts or screws for mounting those components to housing or channel frame 106. In particular and as illustrated in FIG. 9, housing 106 includes a first end 107 and a second end 109. Housing 106 further includes a front leg 110 (also illustrated in FIGS. 2-4) that faces forward, a bottom leg 112 that faces downward, a first back leg 114 that faces backward, a recessed angled leg 116 that faces downwardly at an angle and a second back leg 118 that faces backward. Each of front leg 110, bottom leg 112, first back leg 114, recessed angled leg 116 and second back leg 118 extend from first end 107 to second end 109 of light fixture 102. Mounted to an outer surface of the recessed angled leg 116 are the plurality of lights 108 that also extend from first end 107 to second end 109. In this way, light fixture 102 washes light in a downward direction as illustrated by arrows 126*a*, 126*b* and 126*c*. The downward wash of light illuminates merchandise on gondola display fixture 200.

At the corners where recessed angled leg 116 intersects with first back leg 114 and where recessed angled leg 116 intersects with second back leg 118 are slots 120 and 121. Diffuser 122 sits in slots 120 and 121, covers the plurality of lights 108 and diffuses the light emanating from the plurality of lights 108. Diffuser 122 has a flat and planar shape. Elongated light fixture 102*a* further includes a top cover 124 fixed to housing 106 by at least one fastener, such as a screw. Top cover 124 (also illustrated in FIGS. 2-3) protects the components, such as wires and the LED driver, that are located within an area of the housing 106 defined by front leg 110, bottom leg 112 and first back leg 114, from the environment.

Figure 10:
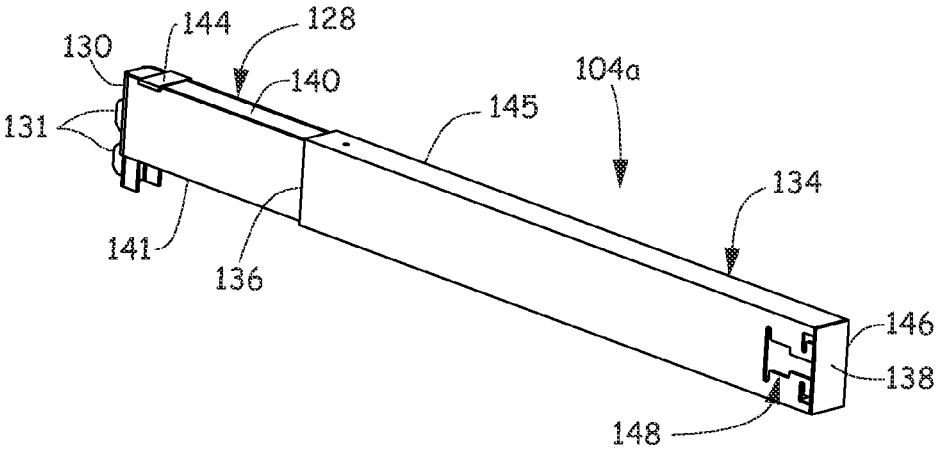
FIG. 10 is a perspective view of a first support arm of the modular valance fixture of FIGS. 1 and 2 according to one embodiment.
Figure 11:
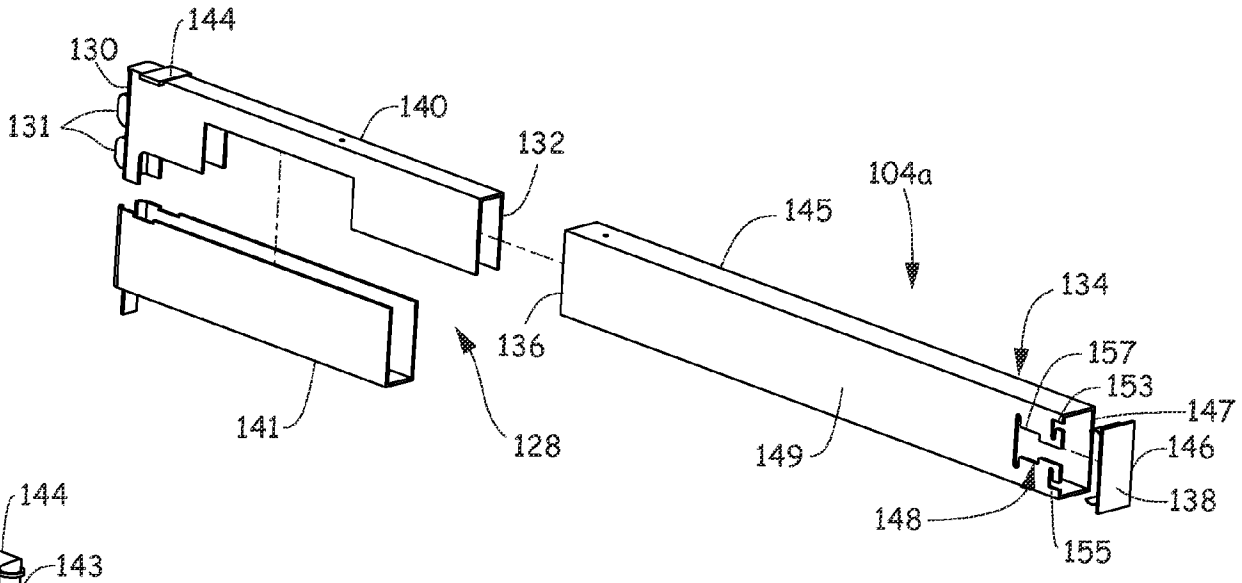
FIG. 11 is a first exploded view of the first support arm illustrated in FIG. 10.
Figure 12:
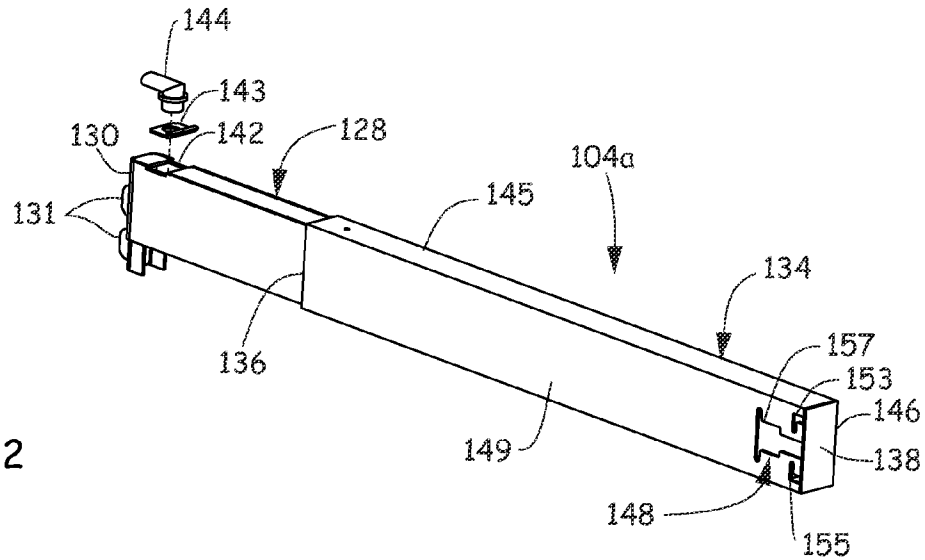
FIG. 12 is a second exploded view of the first support arm illustrated in FIG. 10.

FIG. 10 is a perspective view of first support arm 104*a*, but first support arm 104*a* can be assembled in another configuration so that it can be used as second support arm 104*b*. And support arm 104*b* will be described in detail below. FIG. 11 is a first exploded perspective view of FIG. 10 and FIG. 12 is a second exploded perspective view of FIG. 10. First support arm 104*a* includes an inner assembly or base 128 having a distal end 132 (FIG. 11) and a mounting end or bracket end 130 that mounts to a wall, such as wall 202 in FIG. 1 or wall mount 150 in FIG. 2. First support arm 104*a* further includes an outer assembly or sleeve 134 having an inner assembly receiving end or slide end 136 and a distal end 138. Inner assembly receiving end 136 of outer assembly 134 telescopically receives distal end 132 of base 128.

As illustrated in exploded FIGS. 11 and 12, each of inner assembly 128 and outer assembly 134 includes various parts and components. In FIG. 11, inner assembly 128 includes a top member 140 and a bottom member 141. Top member 140 provides distal end 132 of inner assembly 128 and has a profile for fitting with inner assembly receiving end 136 of outer assembly 134. In addition, top member 140 provides mounting end 130, which includes a plurality of hooks or teeth 131 for mounting to an upright of a wall or to wall mount 150. Bottom member 141 engages with top member 140 and also has a profile when engaged with top member 140 to fit with inner assembly receiving end 136 of outer assembly 134. Together top member 140 and bottom member 141 of inner assembly 128 are made of steel and provide a portion of a wire way from a light fixture to the wall. In FIG. 12, top member 140 of inner assembly 128 includes an opening 142 for receipt of a conduit adapter 144 and an adapter cover 143, which provide power feeds and wire ways to first light fixture 102.

With reference back to FIG. 11, outer assembly 134 includes a tube 145 and a front cap 146. Front cap 146 provides distal end 138 of outer assembly 134 and engages with a distal end 147 of tube 145. Tube 145 of outer assembly 134 includes a first side 149 and a second side (not illustrated in FIGS. 10-12). Tube 145 is made of aluminum and provides a heat sink for the plurality of lights 108 in light fixture 102. Tube 145 of outer assembly 134 of first support arm 104*a* includes a single cutout 148 that is located on one of the sides of tube 145. In particular, cutout 148 is located on first side 149 of tube 145, which is oriented on the left-handed side in FIGS. 10-12, and is formed with distal end 147 of tube 145. Cutout 148 includes three portions: an upper portion 153 and a lower portion 155, which are mirror images of each other, and a center portion 157 that is larger and extends further toward inner assembly receiving end 136 than the upper and lower portions 153 and 155 of cutout 148. Upper and lower portions 153 and 155 provide a way to coupled first support arm to first light fixture 102 and center portion 157 provides an area for wires to pass. In particular, light fixture 102 includes pre-attached screws 159 located on each of first end 107 and second end 109. The upper screw 159 mates with upper portion 153 of cutout 148 and lower screw 159 mates with lower portion 155 of cutout 148. For first support arm 104*a*, cutout 148 is configured to face end 107 of first light fixture 102 illustrated in FIG. 1 so as to become a right-handed support arm for modular valance fixture 100.

Figure 13:
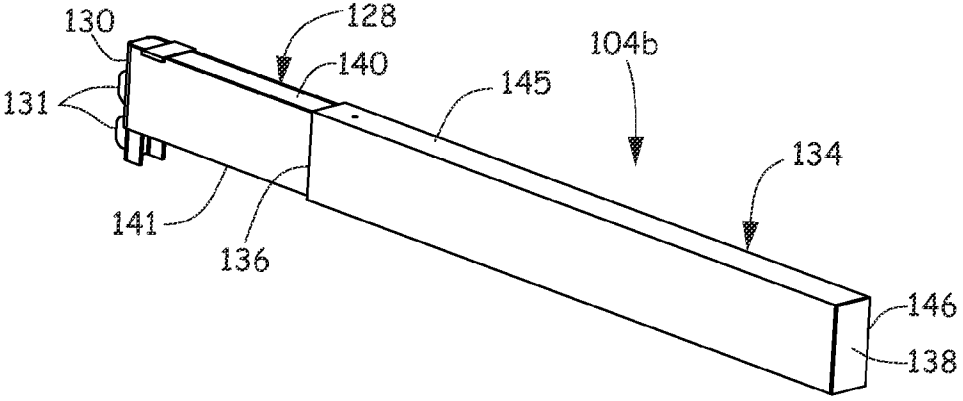
FIG. 13 is a perspective view of second support arm of the modular valance fixture of FIGS. 1 and 2 according to another embodiment.
Figure 14:
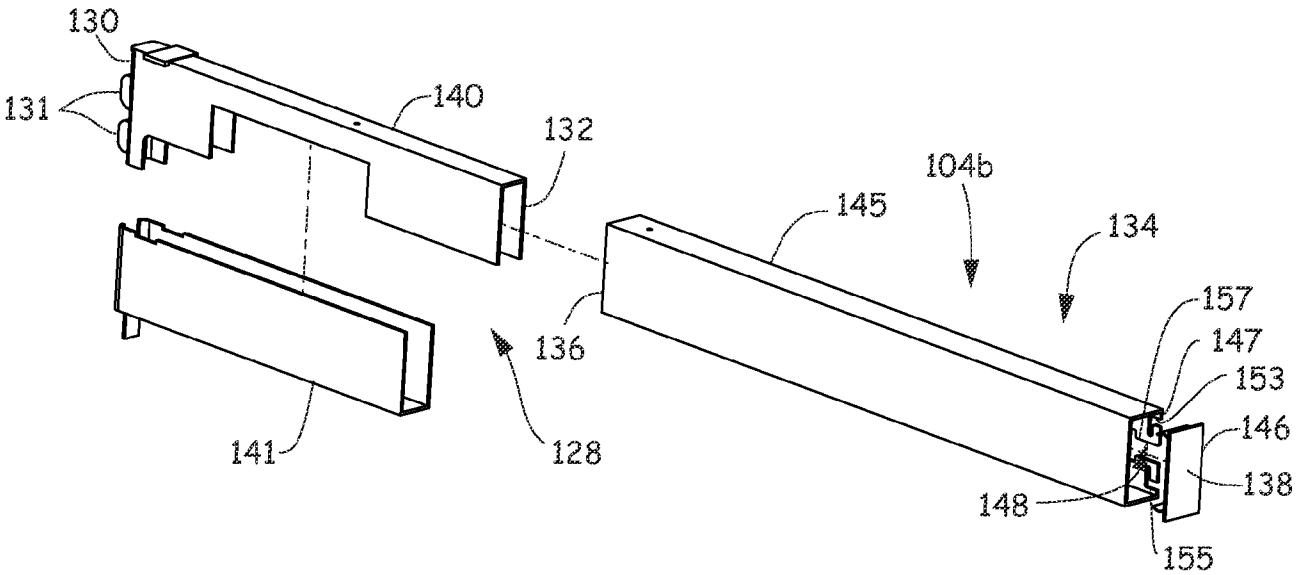
FIG. 14 is an exploded view of the second support arm illustrated in FIG. 13.

FIG. 13 is a perspective view of second support arm 104*b* and FIG. 14 is an exploded perspective view of second support arm 104*b*. Second support arm 104*b* includes identical components to first support arm 104*a* including inner assembly or arm 128 having distal end 132 (FIG. 14) and mounting end or bracket end 130 that mounts to a wall, such as wall 202 in FIG. 1 and wall mount 150 in FIG. 2. Second support arm 104*b* also includes outer assembly or sleeve 134 having inner assembly receiving end or slide end 136 and distal end 138. Like first support arm 104*a*, second support arm 104*b* operates so that inner assembly receiving end 136 of outer assembly 134 telescopically receives distal end 132.

In FIG. 14, inner assembly or base 128 of second support arm 104*b* is identical to first support arm 104*a* and is oriented and used identical to inner assembly 128 in first support arm 104*a*. Inner assembly 128 includes top member 140 and bottom member 141. Top member 140 provides distal end 132 of inner assembly 128 and has a profile for fitting with inner assembly receiving end 136 of outer assembly 134. In addition, inner assembly 128 provides mounting end 130, which includes a plurality of hooks 131 for mounting to an upright of a wall. Bottom member 141 engages with top member 140 and also has a profile when engaged with top member 140 that fits with inner assembly receiving end 136 of outer assembly 134. As described above, top member 140 and bottom member 141 of inner assembly 128 are made of steel and provide a portion of a wire way from a light fixture to the wall.

Figure 15:
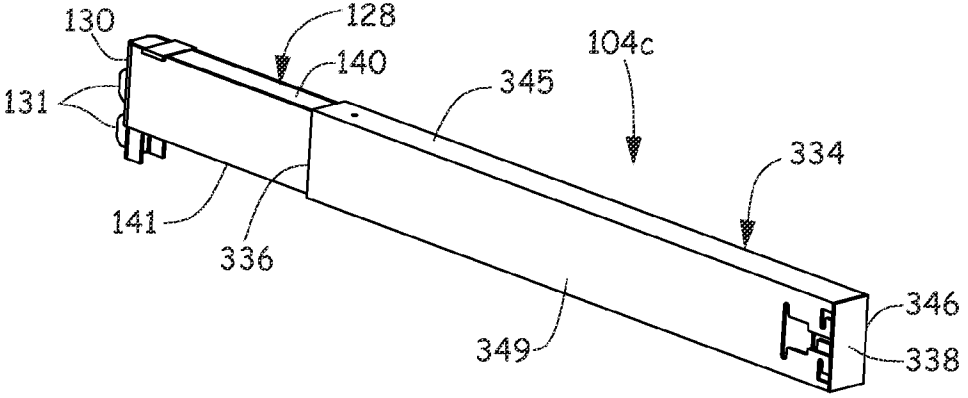
FIG. 15 is a perspective view of a third support arm of the modular valance fixture of FIGS. 1 and 2 according to yet another embodiment.
Figure 16:
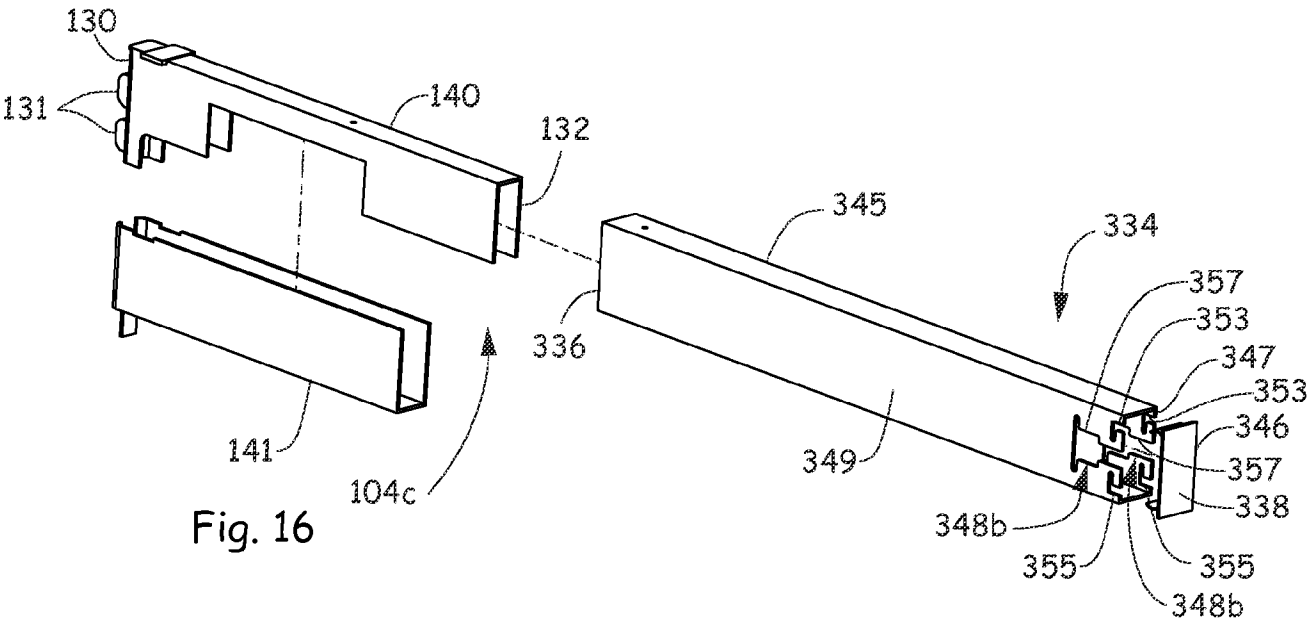
FIG. 16 is an exploded view of the third support arm illustrated in FIG. 15.

In FIG. 14, outer assembly or sleeve 134 of second support arm 104*b* is identical to first support arm 104*a*, but is oriented and used differently from first support arm 104*a*. Outer assembly 134 includes tube 145 and front cap 146. Front cap 146 still provides distal end 138 of outer assembly 134 and still engages with a distal end 147 of tube 145. Tube 145 of outer assembly 134, however, is oriented so that the single cutout 148 located on first side 149 is now on the right-handed side. As described above, tube 145 is made of aluminum and provides a heat sink for the plurality of lights 108 of a light fixture. Cutout 148 still includes three portions: upper and lower portions, which are mirror images of each other, and a center portion 157 that is larger and extends further toward inner assembly receiving end 136 than the upper and lower portions. However, cutout 148 in second support arm 104*a* is configured to face second end 109 of the second light fixture 102 in FIG. 1, so as to become a left-handed support arm for modular valance fixture 100. In this orientation, upper portion 153 has now become the lower portion and lower portion 155 has now become the upper portion FIG. 15 is a perspective view of third support arm 104*c* and FIG. 16 is an exploded perspective view of third support arm 104*c*. Some, but not all, of the components of third support arm 104*c* are identical to first support arm 104*a* and second support arm 104*c*. Inner assembly or arm 128 of third support arm 104*c* is identical to the inner assemblies of first and second support arm 104*a* and 104*b* including distal end 132 (FIG. 15) and mounting end or bracket end 130 that mounts to a wall, such as wall 202 in FIG. 1, or to a wall mount, such as wall mount 150 in FIG. 2. Outer assembly or mid sleeve 334 of third support arm 104*c*, however, is different from outer assembly or sleeve 134 of first and second support arms 104*a* and 104*b*. Outer assembly 334 includes an inner assembly receiving end or slide end 336 and a distal end 338. Like first support arm 104*a* and second support arm 104*b*, third support arm 104*c* operates so that inner assembly receiving end 336 of outer assembly 334 telescopically receives distal end 132 of inner assembly 128. However, distal end 338 is different.

In FIG. 16, inner assembly or arm 128 of third support arm 104*c* is identical to inner assembly 128 of first support arm 104*a* and second support arm 104*b* and is oriented and used identically to inner assembly 128 in first support arm 104*a* and second support arm 104*b*. Inner assembly 128 includes top member 140 and bottom member 141. Top member 140 provides distal end 132 of inner assembly 128 and has a profile for fitting within inner assembly receiving end 136 of outer assembly 134. In addition, inner assembly 128 provides mounting end 130, which includes a plurality of hooks or teeth 131 for mounting to an upright of a wall or to a wall mount. Bottom member 141 engages with top member 140 and also has a profile when engaged with top member 140 that fits within inner assembly receiving end 336 of outer assembly 334. As described above, top member 140 and bottom member 141 of inner assembly 128 are made of steel and provide a portion of a wire way from a light fixture to the wall.

In FIG. 15, outer assembly or mid sleeve 334 of third support arm 104*c* includes tube 345 and front cap 346. Front cap 346 provides distal end 338 of outer assembly 334 and engages with a distal end 347 of base member 345. As described above, tube 345 is made of aluminum and provides a heat sink for the plurality of lights 108 of a light fixture. Tube 345 of outer assembly 334 differs from tube 145 of support arms 104*a* and 104*b* because tube 345 includes two cutouts 348*a* and 348*b*. First cutout 348*a* is located on first side 349 of tube 345 and is formed with distal end 347 of tube 345. First side 349 is oriented to be a left-handed side of tube 345. Second cutout 348*b* is located on second side (not shown in FIGS. 15 and 16) of tube 345 and is also formed with distal end 347 of tube 345. The second side is oriented to be a right-handed side of tube 345. Cutouts 348*a* and 348*b* each include the three portions of cutout 148: an upper portion 353 and a lower portion 355, which are minor images of each other, and a center portion 357 that is larger and extends further toward inner assembly receiving end 336 than the upper and lower portions. However, first cutout 348*a* in third support arm 104*c* is configured to face a first end 107 of the second light fixture 102 in FIGS. 1 and 2 and second cutout 348*b* in third support arm 104*c* is configured to face a second end 109 of first light fixture 102 in FIGS. 1 and 2. In addition, upper screw 159 of light fixture 102 mates with upper portion 353 of cutouts 348*a* or 348*b* and lower screw 159 mates with lower portion 355 of cutouts 348*a* or 348*b*. Third support arm 104*c* becomes a mid support arm for modular valance fixture 100.

With reference back to FIG. 1, modular valance fixture 100 includes two identical light fixtures 102, three identical inner assemblies or bases 128, two identical outer assemblies or sleeves 134 and one different outer assembly 334.

Outer assemblies 134 are identical, but assembled to modular valance fixture 100 in two different orientations. For first support arm 104*a* and the first orientation, first side 149 having cutout 148 is orientated to be on a left-handed side of sleeve 134. For second support arm 104*b* and the second orientation, first side 149 having cutout is orientated to be on a right-handed side of sleeve 134. For third support arm 104*c*, the orientation is unimportant just as long as first cutout 348*a* and 348*c* are on the left-handed and right-handed side of sleeve 334.

Although modular valance fixture 100 illustrates only two light fixtures 102, it is possible for modular valance fixture 100 to have many more. In this embodiment, modular valance fixture 100 will still only include a single first support arm 104*a* and a single second support arm 104*b*. However, to support all of the additional light fixtures, for every additional light fixture added beyond two light fixture, an additional third support arm or mid support arm 104*c* will be needed.

Although modular valance fixture 100 illustrates two light fixtures 102, it is possible for modular valance fixture 100 to have only one light fixture 102. In this embodiment, modular valance fixture 100 will only include a single first support arm 104*a*, a single second support arm 104*b* and third support arm 104*c* will be removed from modular valance fixture 100.

Figure 17:
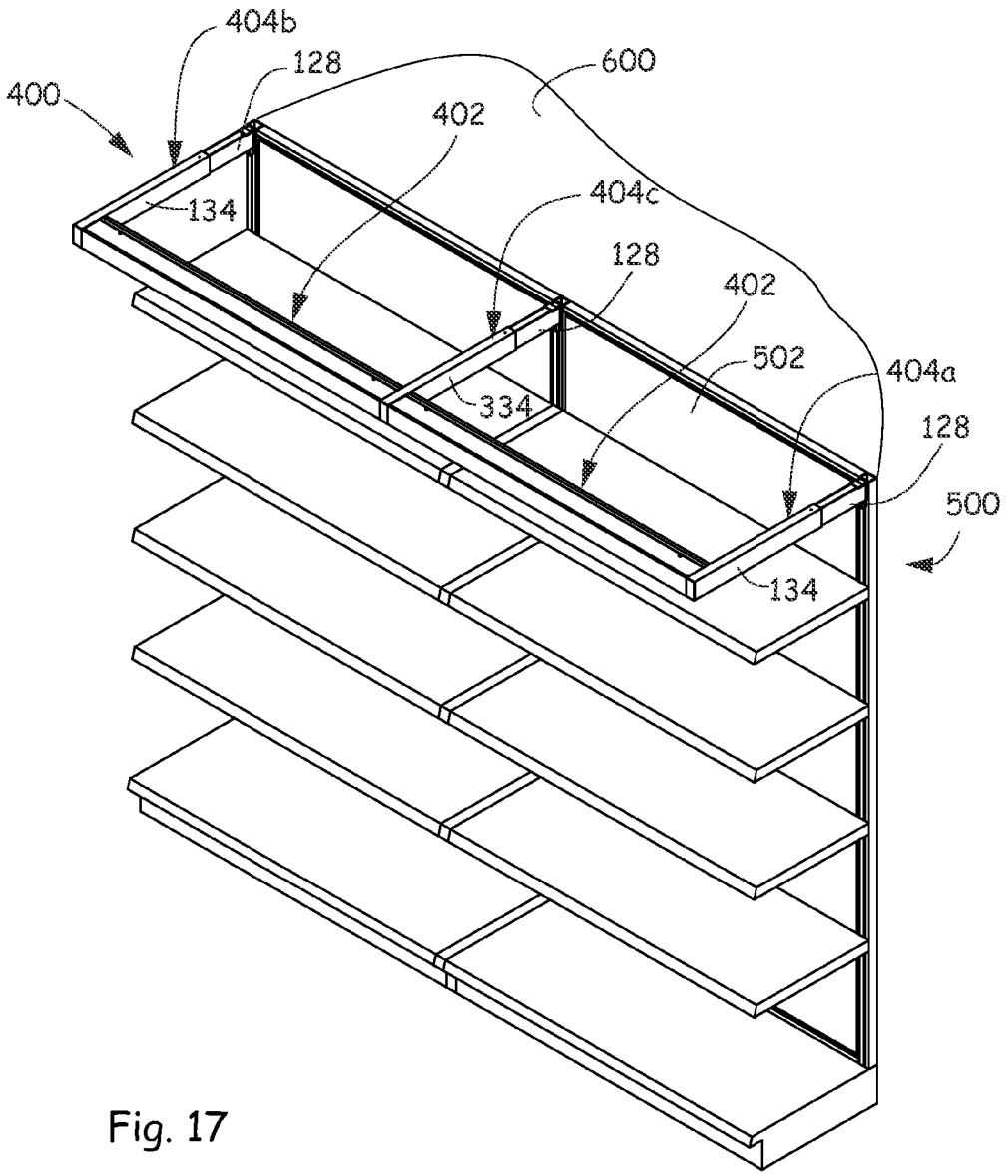
FIG. 17 is a perspective view of a modular valance fixture lighting a display fixture and a wall according to another embodiment.

FIG. 17 is a perspective view of a modular valance fixture 400 for lighting a gondola display fixture 500 and a back wall 600 according to another embodiment. Modular valance fixture 400 includes at least one elongated light fixture or light assembly 402. In FIG. 17, two elongated light fixtures or light assemblies 402 are shown. Modular valance fixture 400 further includes at least two support arms. In FIG. 17, a first support arm 104*a*, a second support arm 104*b* and a third support arm 104*c* are shown. In particular, support arms 104*a*, 104*b* and 104*c* are those supports arms described above and include three identical inner assemblies or bases 128, two identical outer assemblies or sleeves 134 and one different outer assembly 334. Outer assemblies 134 are identical, but assembled to modular valance fixture 400 in two different orientations. For first support arm 104*a* and the first orientation, first side 149 having cutout 148 is orientated to be on a left-handed side of sleeve 134. For second support arm 104*b* and the second orientation, first side 149 having cutout is orientated to be on a right-handed side of sleeve 134. For third support arm 104*c*, the orientation is unimportant just as long as first cutout 348*a* and 348*c* are on the left-handed and right-handed side of sleeve 334.

Figure 18:
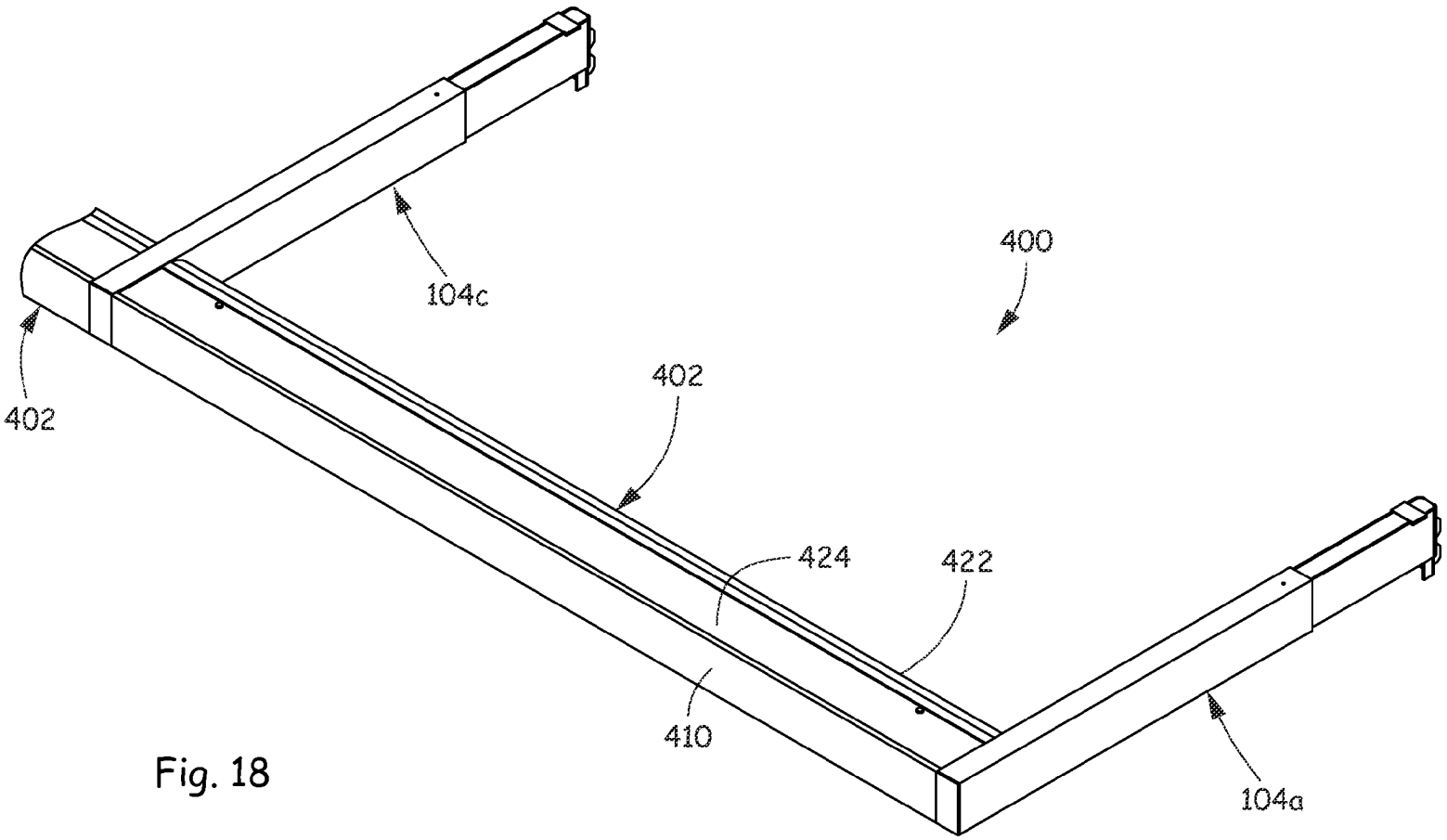
FIG. 18 is a perspective view of a portion of the modular valance fixture illustrated in FIG. 17.
Figure 19:
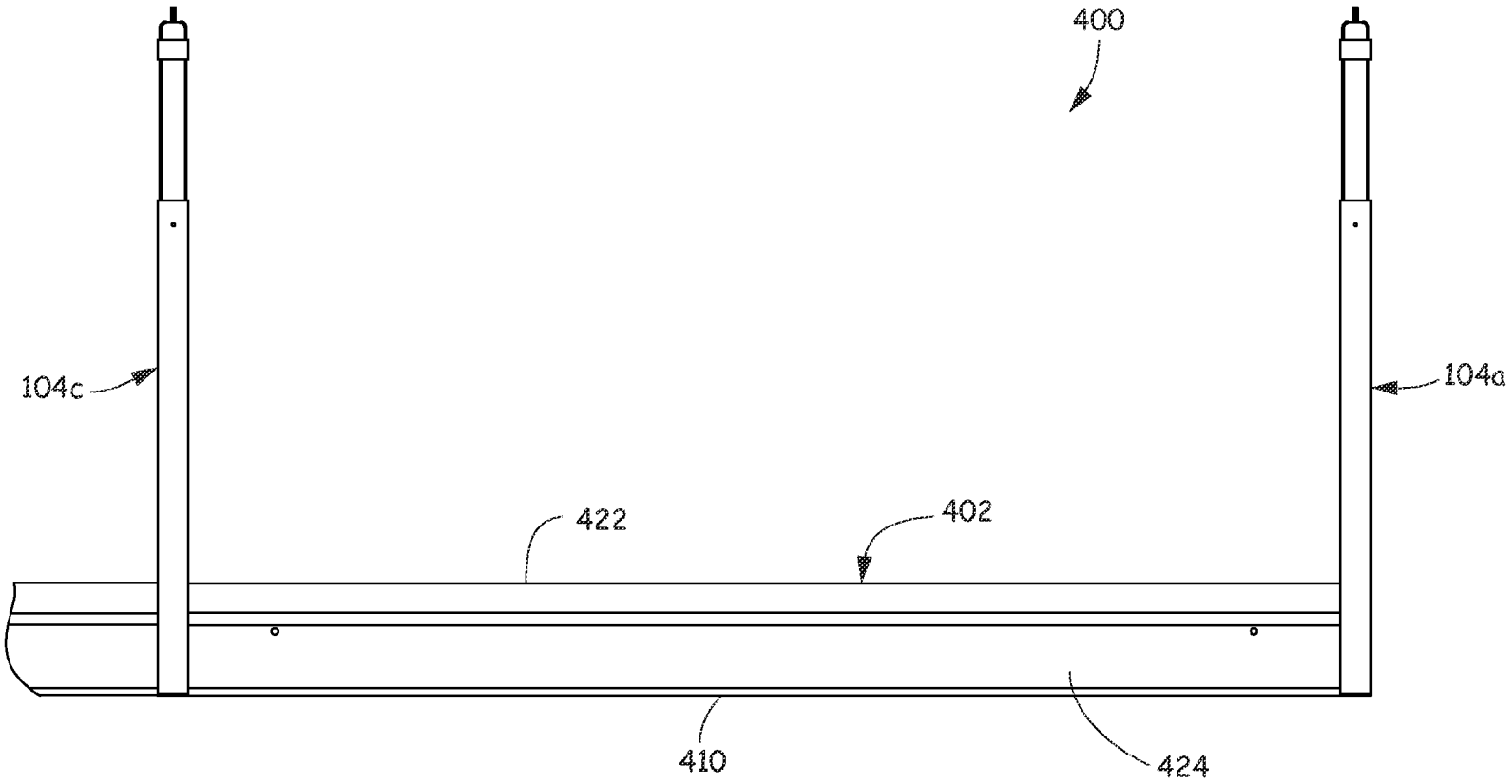
FIG. 19 is a top view of FIG. 18.
Figure 20:
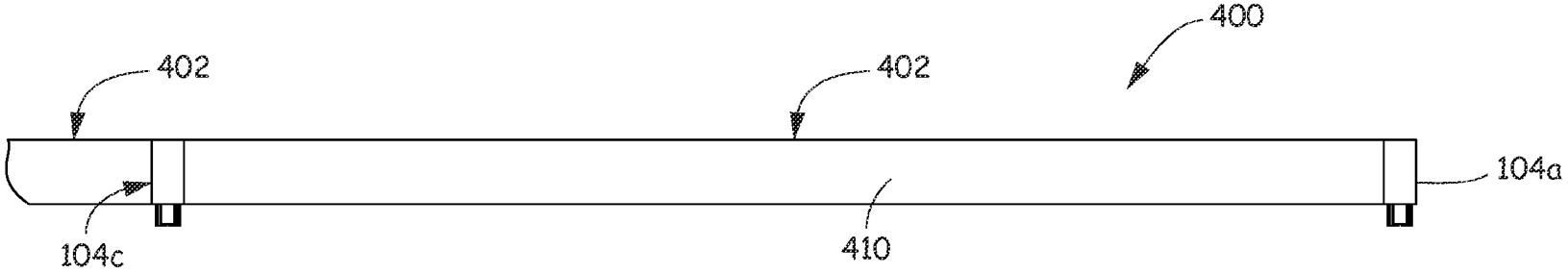
FIG. 20 is a front view of FIG. 18.
Figure 21:
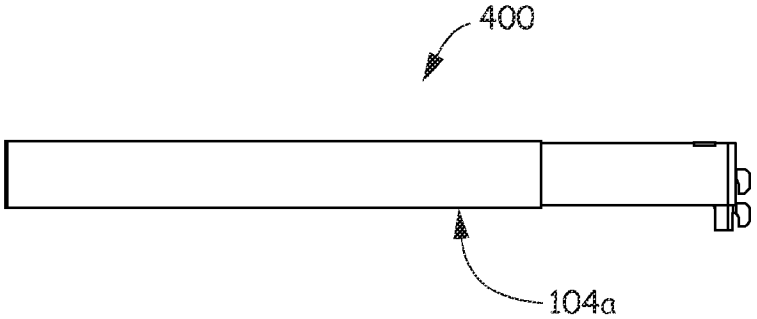
FIG. 21 is a right side view of FIG. 18.

FIG. 18 is a perspective view of a portion of modular valance fixture 400 including first support arm 104*a*, third support arm 104*c* and first elongated light fixture 402. FIG. 19 is a top view of FIG. 18, FIG. 20 is a front view of FIG. 18 and FIG. 21 is a right side view of FIG. 18. First support arm 104*a* and third support arm 104*c*; position first elongated light fixture 402 away from wall 502 of gondola display fixture 500. With reference back to FIG. 17, second support arm 104*b* and third support arm 104*c* position second elongated light fixture 102 away from wall 502.

Figure 22:
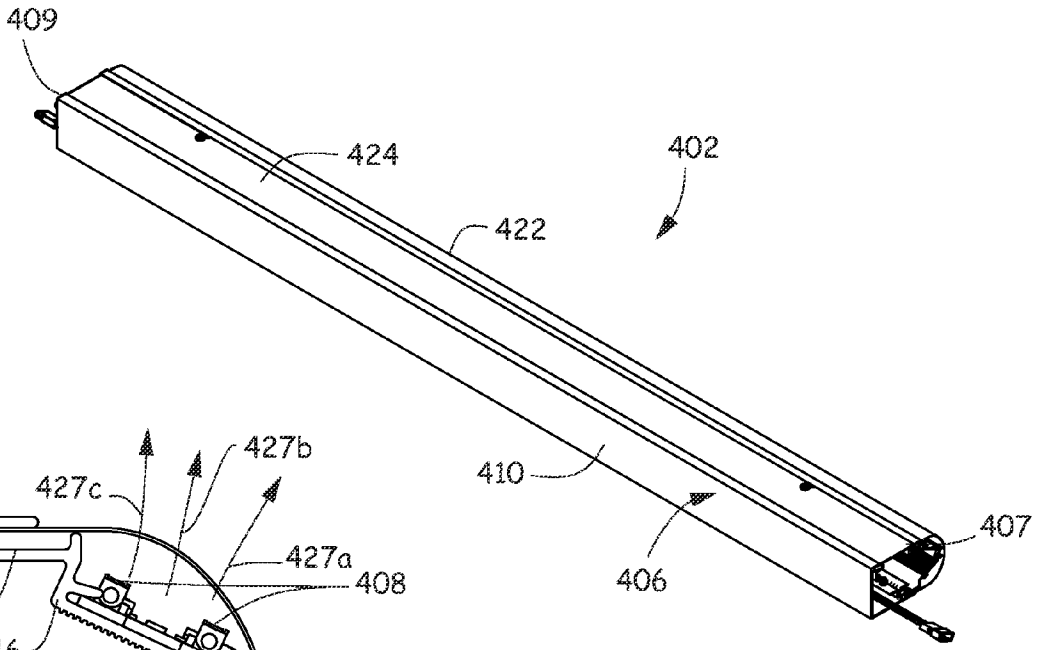
FIG. 22 is a perspective view of a light assembly of the modular valance fixture of FIG. 18.
Figure 25:
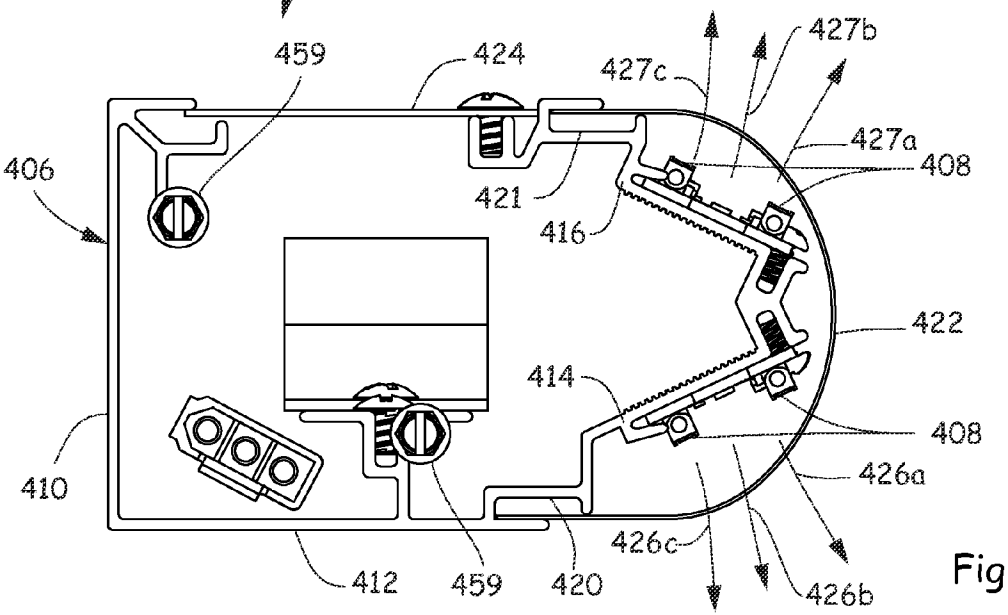
FIG. 25 is an enlarged right side view of FIG. 22.
Figure 23:
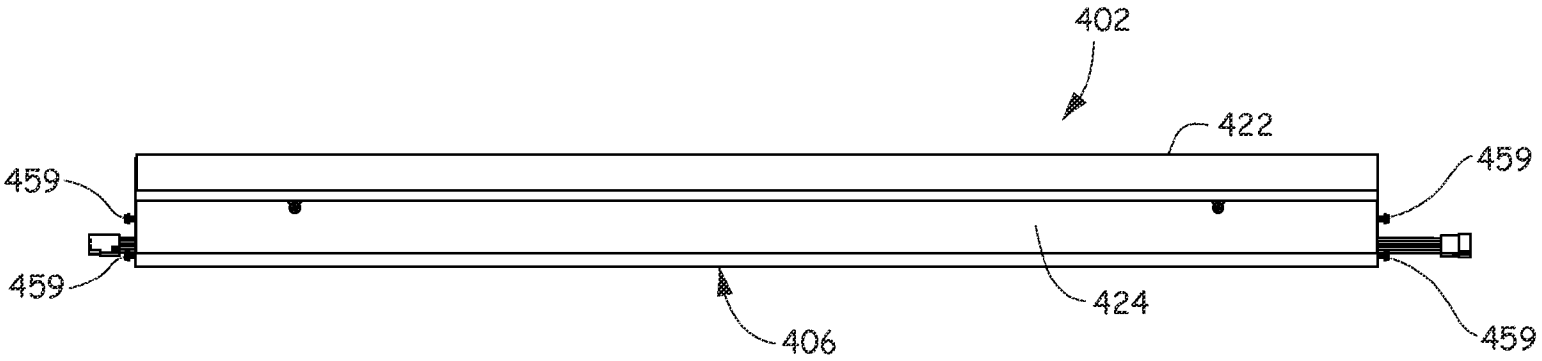
FIG. 23 is a top view of FIG. 22.
Figure 24:
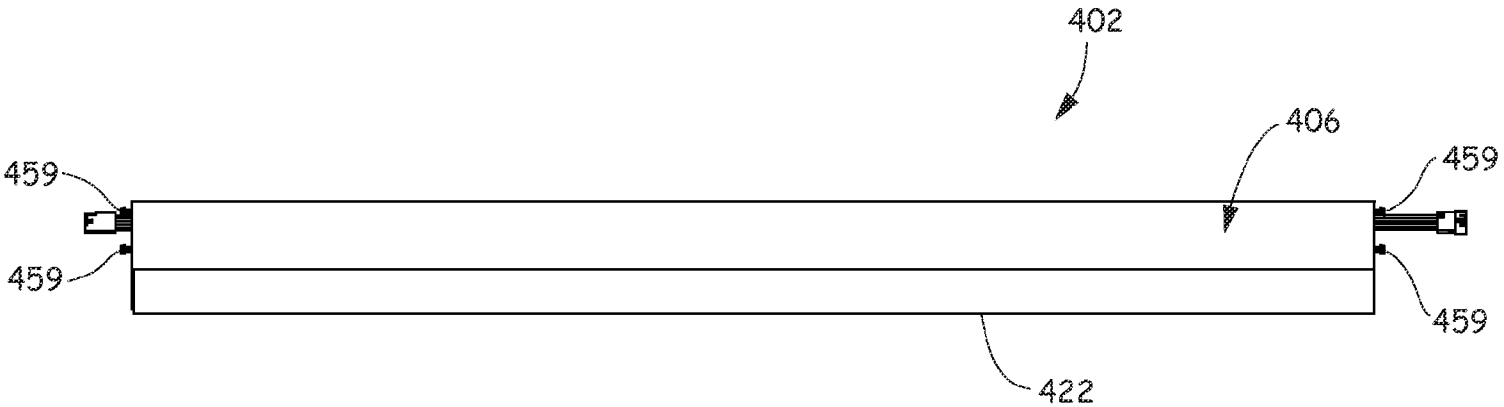
FIG. 24 is a bottom view of FIG. 22.

FIG. 22 is a perspective view of light assembly 402. In particular, FIG. 22 is a perspective view of first elongated light fixture 202, but second elongated light fixture 202 is identical to first elongated light fixture 202. In fact, any of the elongated light fixtures used in modular valance fixture 400 are identical. FIG. 23 is a top view of FIG. 22, FIG. 24 is a bottom view of FIG. 22 and FIG. 25 is an enlarged right side view of FIG. 22.

Elongated light fixture 402 includes a housing or channel frame 406 to which a plurality of lights 408 are mounted and that contains components for providing the plurality of lights 408 with power. For example, lights 408 can be LEDs that are provided on a board that is mounted to housing or channel frame 406 and housing or channel frame 406 can contain various components, such as wires, quick connects, a LED driver and bolts or screws for mounting those components to housing or channel frame 406. In particular and as illustrated in FIG. 22, housing 406 includes a first end 407 and a second end 409. Housing 406 further includes a front leg 410 (also illustrated in FIGS. 18-20) that faces forward, a bottom leg 412 that faces downward, a first angled leg 414, that faces downwardly at an angle and a second angled leg 416 that faces upwardly at an angle. Each of front leg 410, bottom leg 412, first angled leg 414 and second angled leg 416 extend from first end 407 to second end 409 of light fixture 402. Mounted to an outer surface of first angled leg 414 and to an outer surface of second angled leg 416 are the plurality of lights 408 that also extend from first end 407 to second end 409. In this way, light fixture 402 washes light in a downward direction as illustrated by arrows 426*a*, 426*b* and 426*c* and in an upward direction as illustrated by arrows 427*a*, 427*b* and 427*c*. The downward wash of light illuminates merchandise on gondola display fixture 500. The upward wash of light illuminates retail store wall 600, which can be painted or include graphics, etc.

At the corners where first angled leg 414 intersects with bottom leg 412 and where second angled leg 416 meets with a top cover 424 are slots 420 and 421. Slot 420 is located on a bottom of light assembly 402 and slot 421 is located on a top of light assembly 402. Diffuser 422 sits in slots 420 and 421, covers the plurality of lights 408 and diffuses the light emanating from the plurality of lights 408 to form the upward wash of light and the downward wash of light. Diffuser 422 has a curved or arcuate shape in order to cover both directions of upward washing and downward washing lights. Elongated light fixture 402 further includes top cover 424 fixed to housing 406 by at least one fastener, such as a screw. Top cover 424 (also illustrated in FIGS. 22-23) protects the components, such as wires and the driver, that are located within an area of the housing 406 defined by front leg 410, bottom leg 412, first angled leg 414 and second angled leg 416 from the environment. Still further, elongated fixture 402 includes pre-attached screws 459 located on each of first end 407 and second end 409. The upper screw 459 mates with upper portion 153 of cutout 148 or 353 of cutouts 348*a* or 348*b* and lower screw 459 mates with lower portion 155 of cutout 148 or 355 of cutouts 348*a* or 348*b*.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A modular valance fixture comprising:

at least one elongated light fixture including a channel frame to which a plurality of lights are mounted and that contains components for providing the plurality of lights with power and a diffuser that covers the plurality of lights, the channel frame including a first end and a second end;

at least two identical bases each having a distal end and a mounting end that mounts to a wall; and at least two identical sleeves each including a slide end that telescopically receives the distal end of one of the bases, a distal end and a tube having a first side and a second side, wherein the first side of each tube of the identical sleeves includes a cutout; and wherein each of the at least two identical sleeves are oriented in one of two orientations so as to either act as a left-handed support or as a right-handed support for the at least one elongated light fixture, wherein a first orientation includes the first side being oriented such that the cutout is located on a left-handed side of the sleeve and faces the first end of the channel frame and wherein a second orientation includes the first side being oriented such that the cutout is located on a right-handed side of the sleeve and faces the second end of the channel frame.

2. The modular valance fixture of claim 1, wherein the at least one elongated light fixture comprises first and second identical elongated light fixtures each including the channel frame having the first and second ends.

3. The modular valance fixture of claim 2, wherein the at least two identical bases comprise at least three identical bases each having the mounting end that mounts to the wall and the distal end.

4. The modular valance fixture of claim 3, further comprising at least one mid sleeve having a slide end that telescopically receives the distal end of one of the bases and having a left-handed side, a right-handed side and a distal end, wherein the left-handed side of the mid sleeve includes a first cutout that faces the first end of the second elongated light fixture and wherein the right-handed side includes a second cutout that faces the second end of the first elongated light fixture.

5. The modular valance fixture of claim 4, wherein each of the at least two substantially identical sleeves and the at least one mid sleeve are made of aluminum and provide a heat sink for the plurality of lights.

6. The modular valance fixture of claim 1, wherein each of the at least two substantially identical bases are made of steel and provide a wire way to the wall.

7. The modular valance fixture of claim 1, wherein the plurality of lights are attached to an outer surface of a portion of the channel frame that faces downward so that the at least one elongated light fixture washes light in a downward direction.

8. The modular valance fixture of claim 7, wherein the diffuser is planar and sits in slots located on the outer surface of the channel frame.

9. The modular valance fixture of claim 1, wherein a first portion of the plurality of lights are attached to an outer surface of the channel frame that faces upward and a second portion of the plurality of light are attached to an outer surface of the channel frame that faces downward so that the at least one elongated light fixture washes light in an upward direction and in a downward direction.

10. The modular valance fixture of claim 9, wherein the diffuser is curved to cover both the plurality of lights that wash light in the downward direction and the plurality of lights that wash light in the upward direction and sits in slots located on a top of the channel frame and a bottom of the channel frame.

11. A modular valance fixture comprising:

a first support arm including an inner assembly having a bracket end that is mounted to a wall and a distal end and an outer assembly having an inner assembly receiving end and a distal end, wherein the outer assembly includes a cutout located on one side of a tube of the outer assembly;

a second support arm including an inner assembly that is identical to the inner assembly of the first support arm and an outer assembly that is identical to the outer assembly of the first support arm; and at least one light assembly including a housing to which a plurality of lights are mounted and that contains components for providing the plurality of lights with power, wherein the at least one light assembly is supported away from the wall by at least one of the first support arm and the second support arm; and wherein the identical outer assemblies are assembled to the identical inner assemblies so that the side of the outer assembly of the first support arm that includes the cutout is facing a first end of the housing of the at least one light assembly and the side of the outer assembly of the second support arm that includes the cutout is facing a second end of the housing of the at least one light assembly.

12. The modular valance fixture of claim 11, wherein the at least one light assembly further comprises a top cover for protecting the components that provide the plurality of lights with power.

13. The modular valance fixture of claim 11, wherein the plurality of lights are all mounted to an outer surface of the housing and are covered by a diffuser that has a planar shape.

14. The modular valance fixture of claim 11, wherein the at least one light assembly further comprises an arcuate diffuser where a portion of the plurality of lights are mounted to a first outer surface of the housing and a remaining portion of the plurality of lights are mounted to a second outer surface of the housing.

15. The modular valance fixture of claim 11, wherein the at least one light assembly comprises at least a first light assembly, a second light assembly and a third support arm, the third support arm including an inner assembly that is identical to the inner assemblies of the first support arm and the second support arm and an outer assembly that is different from the identical outer assemblies of the first support arm and the second support arm, wherein the outer assembly of the third support arm has a first cutout on a first side the tube and a second cutout on a second side of the tube.

16. The modular valance fixture of claim 15, wherein the outer assembly of the first support arm is coupled to the first end of the housing of the first light assembly, the outer assembly of the third support arm is coupled to the second end of the housing of the first light assembly and coupled to a first end of a housing of the second light assembly and the outer assembly of the second support arm is coupled to the second end of the housing of the second light assembly.

17. A method of assembling a modular valance fixture, the method comprising:

mounting a first support arm to a wall by attaching an inner assembly to the wall and sliding an outer assembly telescopically onto a distal end of the inner assembly, wherein the outer assembly is slid on the distal end of the inner assembly so that a side of the outer assembly that has a cutout is on a left-handed side and the cutout is located proximate to a distal end of the outer assembly;

mounting a second support arm to the wall by attaching an inner assembly that is substantially identical to the inner assembly of the first support arm to the wall and sliding an outer assembly that is substantially identical to the outer assembly of the first support arm telescopically onto a distal end of the inner assembly of the second support arm, wherein the outer assembly of the second support arm is slid on the distal end of the inner assembly of the second support arm so that a side of the outer assembly that has a cutout is on a right-handed side and the cutout is located proximate to a distal end of the outer assembly of the second support arm; and supporting a light assembly away from the wall with the first support arm and the second support arm, wherein the cutout on the outer assembly of the first support arm faces a first end of the light assembly and the cutout on the outer assembly of the second support arm faces a second end of the light assembly.

18. The method of claim 17, further comprising mounting a third support arm to the wall by attaching an inner assembly that is substantially identical to the inner assemblies of the first support arm and the second support arm and sliding an outer assembly that is different from the outer assemblies of the first support arm and the second support arm telescopically onto a distal end of the inner assembly of the third support arm, wherein the outer assembly of the third support assembly is slid on the distal end of the inner assembly of the third support arm so that a cutout located on the right-handed side of the outer assembly and a cutout located on the left-handed side of the outer assembly are located proximate a distal end of the outer assembly of the third support arm.

19. The method of claim 18, wherein supporting the light assembly away from the wall with the first support arm and the second support arm further comprises supporting the light assembly and a second light assembly away from the wall with the first support arm, the second support arm and the third support arm.

20. The method of claim 19, wherein supporting the light assembly comprises facing the cutout on the outer assembly of the first support arm at the first end of the light assembly and facing the cutout on the right-handed side of the outer assembly of the third support arm at the second end of the light assembly and wherein supporting the second light assembly comprises facing the cutout on the left-handed side of the outer assembly of the third support at a first end of the second light assembly and facing the cutout on the outer assembly of the second support arm at a second end of the second light assembly.

* * * * *